US006951371B2

(12) United States Patent
Wang

(10) Patent No.: US 6,951,371 B2
(45) Date of Patent: Oct. 4, 2005

(54) MULTI-FUNCTIONAL CHILD HIGH CHAIR

(76) Inventor: Kun Wang, P.O. Box 697, Feng-Yuan City, Taichung Hsien (TW), 420

( * ) Notice: Subject to any disclaimer, the term of this patent is extended or adjusted under 35 U.S.C. 154(b) by 0 days.

(21) Appl. No.: 10/442,969

(22) Filed: May 22, 2003

(65) Prior Publication Data

US 2005/0110320 A1 May 26, 2005

(51) Int. Cl.[7] ..... A47C 1/02

(52) U.S. Cl. ..... 297/344.14; 297/344.13; 297/130; 297/344.18; 248/429

(58) Field of Search ..... 248/429, 430; 297/344.14, 344.12, 344.18, 148, 153, 16.1, 32, 118, 130, 131, 271.5, 271.6, 258.1

(56) References Cited

U.S. PATENT DOCUMENTS 3,172,696 A * 3/1965 De Vos ..... 297/16.1
3,759,539 A * 9/1973 Goldberg ..... 280/87.03
5,131,719 A * 7/1992 Kassai ..... 297/344.18
5,348,374 A * 9/1994 Kuo ..... 297/344.18
5,820,207 A * 10/1998 Wang ..... 297/27
5,893,606 A * 4/1999 Chiang ..... 297/118
5,951,102 A * 9/1999 Poulson et al. ..... 297/130
6,126,236 A * 10/2000 Wu ..... 297/325
6,174,028 B1 * 1/2001 Yang et al. ..... 297/258.1
6,347,830 B1 * 2/2002 Chen ..... 297/16.1

* cited by examiner

*Primary Examiner*—Peter M. Cuomo
*Assistant Examiner*—Erika Garrett

(57) ABSTRACT

A multi-functional child high chair includes a pair of incurved fore legs and a pair of incurved rear legs collapsibly connected by a pair of circular joints, a first stretcher connected the lower end of the fore legs including a pair of casters at two end, a second stretcher connected the lower end of the rear legs including two caster at each end, a pair of rotary positioning joint slidably sleeved on the upper portion of the fore legs respectively and axially connected to a chair seat therebetween. The chair seat has an angle of elevation adjustable chair back, a large and a small platform and an adjustable foot rest. The rotary positioning joints facilitate the ascent and descent of the chair seat along the guide groove of the fore legs. A pair of drag devices respectively disposed in the fore legs and controlled by the rotation of the circular joints. When the legs are collapsed and laid on the ground, the chair is swinging to and fro as a cradle and/or stably supported by a pair of spare supports to become a bed for a child.

6 Claims, 24 Drawing Sheets

MULTI-FUNCTIONAL CHILD HIGH CHAIR

BACKGROUND OF THE INVENTION

The present invention relates to children apparatus and more particularly to a multi-functional child high chair which is collapsible and in which the chair seat can be vertically adjustable, and wobbly to and fro as swinging on a swing.

The children high chair is available in the market and is varied in types. In the family or restaurant, this high chair is used to serve for a child to have meal together with its parents. Some of the high chairs can adjust their height in order to enable the child to reach the table and some of the high chairs directly make a releasable platform in front of the chair to facilitate the child to eat itself. However, these types of high chair only provide a single function. If wishes to cheer the child, one has to buy other children apparatus such as a wobbly playpen or a cradle. Therefore, if a collapsible multi-functional child high chair which facilitates the child to sit in, to feed on and to swing about is available, it will provide great convenience and happiness to the parents.

SUMMARY OF THE PRESENT INVENTION

The present invention has a main object to provide a multi-functional child high chair which is collapsible to reduce the volume to facilitate to collect or to pack for transportation.

Another object of the present invention is to provide a multi-functional child high chair in which the chair seat is vertically adjustable and wobbly to and fro as to swing on a swing.

Still another object of the present invention is to provide a multi-functional child high chair which includes a releasable platform in front of the chair seat to facilitate the child to have meal or to play toys thereon.

Further object of the present invention is to provide a multi-functional child high chair which provides a linking-up device to actuate a drag device in order to facilitate the chair seat to descend to a lowermost position.

Further object of the present invention is to provide a multi-functional child high chair when adjust the height of the chair seat, it always keeps horizontal state.

Further object of the present invention is to provide a multi-functional child high chair in which the angle of elevation of the chair back is adjustable to facilitate the child to lie on its back.

The present invention will become more fully understood by reference to the following detailed description thereof when read in conjunction with the attached drawings.

DETAILED DESCRIPTION OF THE PREFERRED EMBODIMENT

Figure 1:
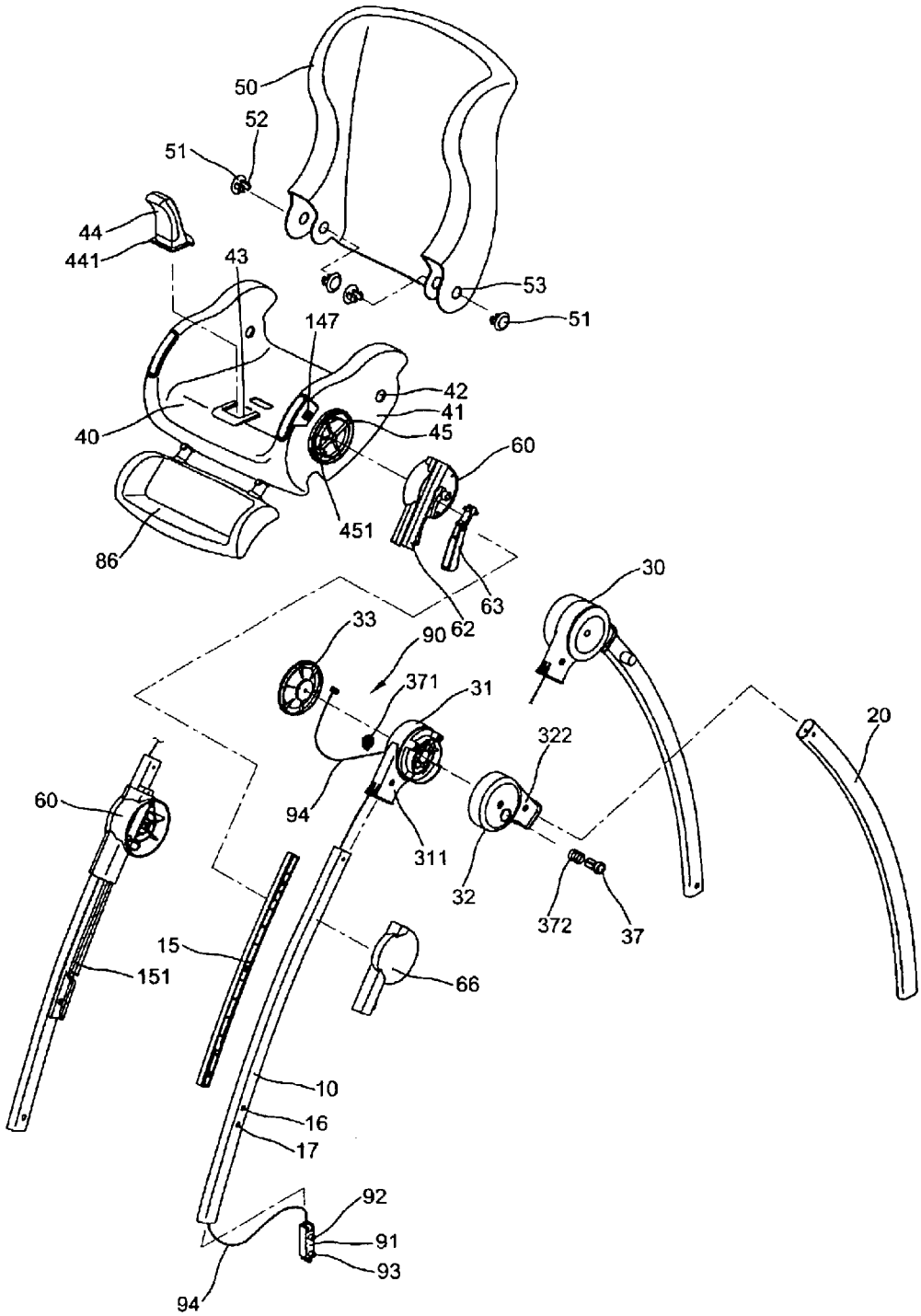
FIG. 1 is an exploded perspective view to show the preferred embodiment of the child high chair of the present invention.
Figure 2:
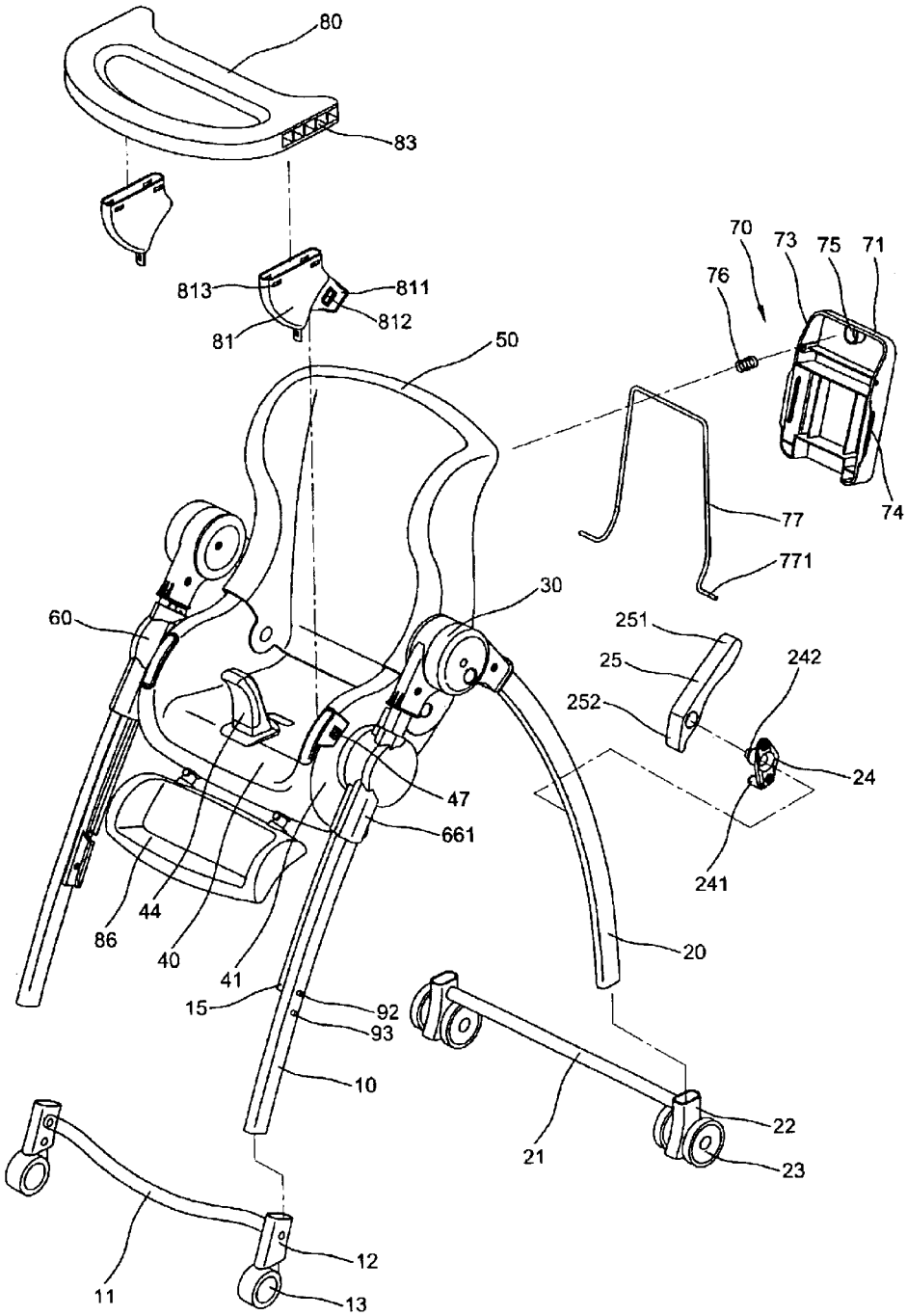
FIG. 2 is an assembly view and partially exploded perspective view to show the large and small platforms, the angle adjustment device and the stretchers.
Figure 3:
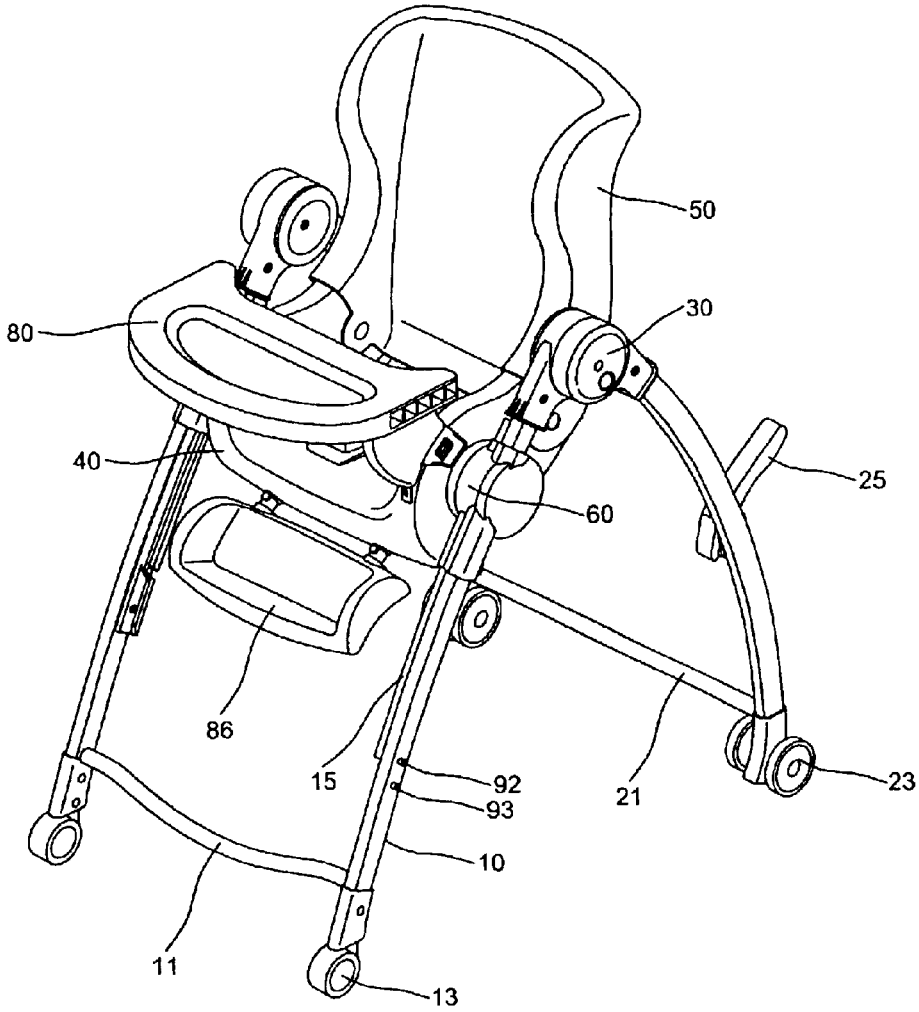
FIG. 3 is a perspective view to show the assembly of FIG. 2.

With reference to FIGS. 1, 2 and 3 of the drawings, the multi-functional child high chair of the present invention comprises generally a pair of fore legs 10, a pair of rear legs 20, two circular joints 30, a chair seat 40, a chair back 50, two rotary positioning joints 60, an angle adjustment device 70, a small platform 80 and a pair of drag devices 90.

Figure 15:
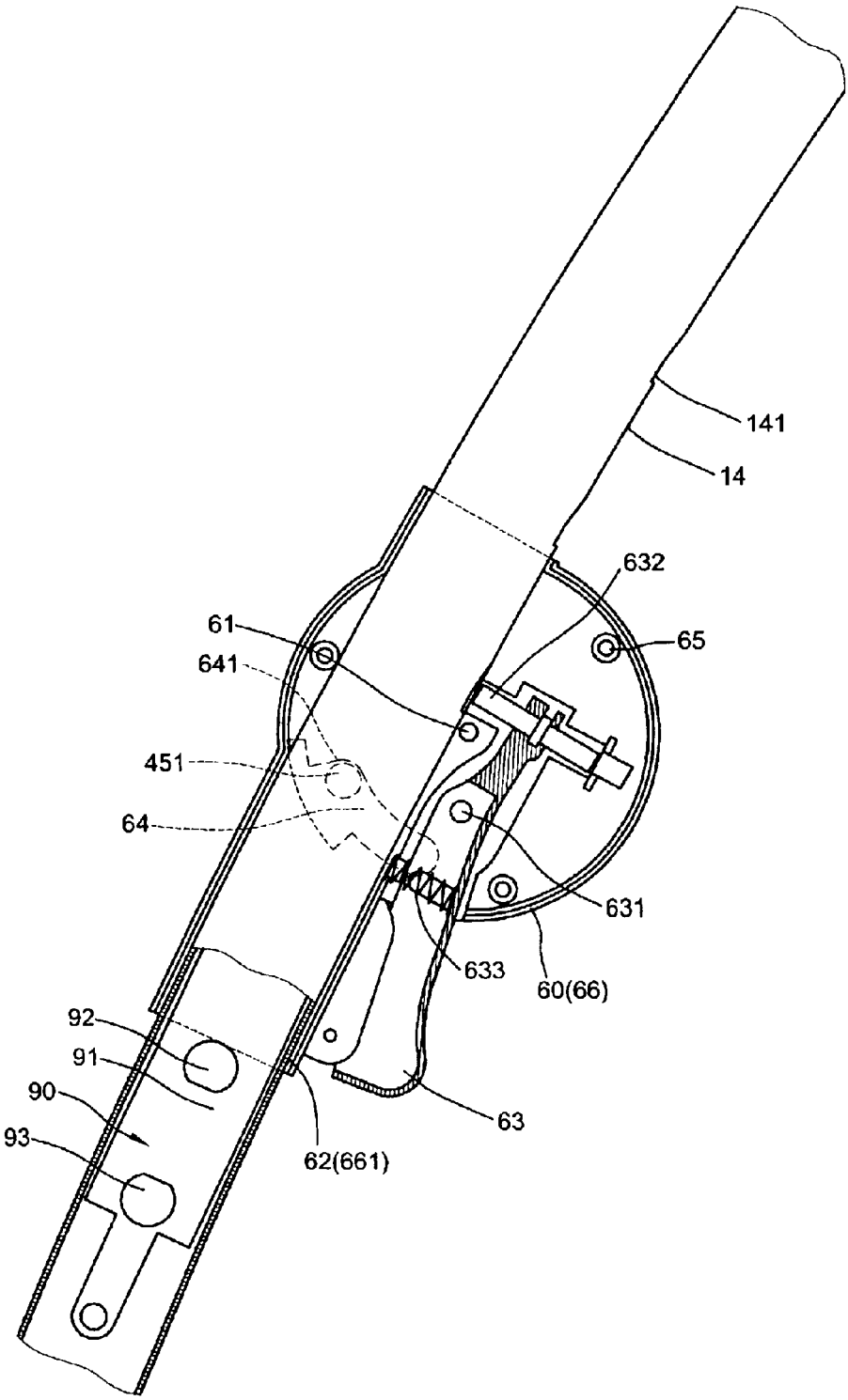
FIG. 15 is a sectional view to show the rotary positioning joint moving downward.
Figure 21:
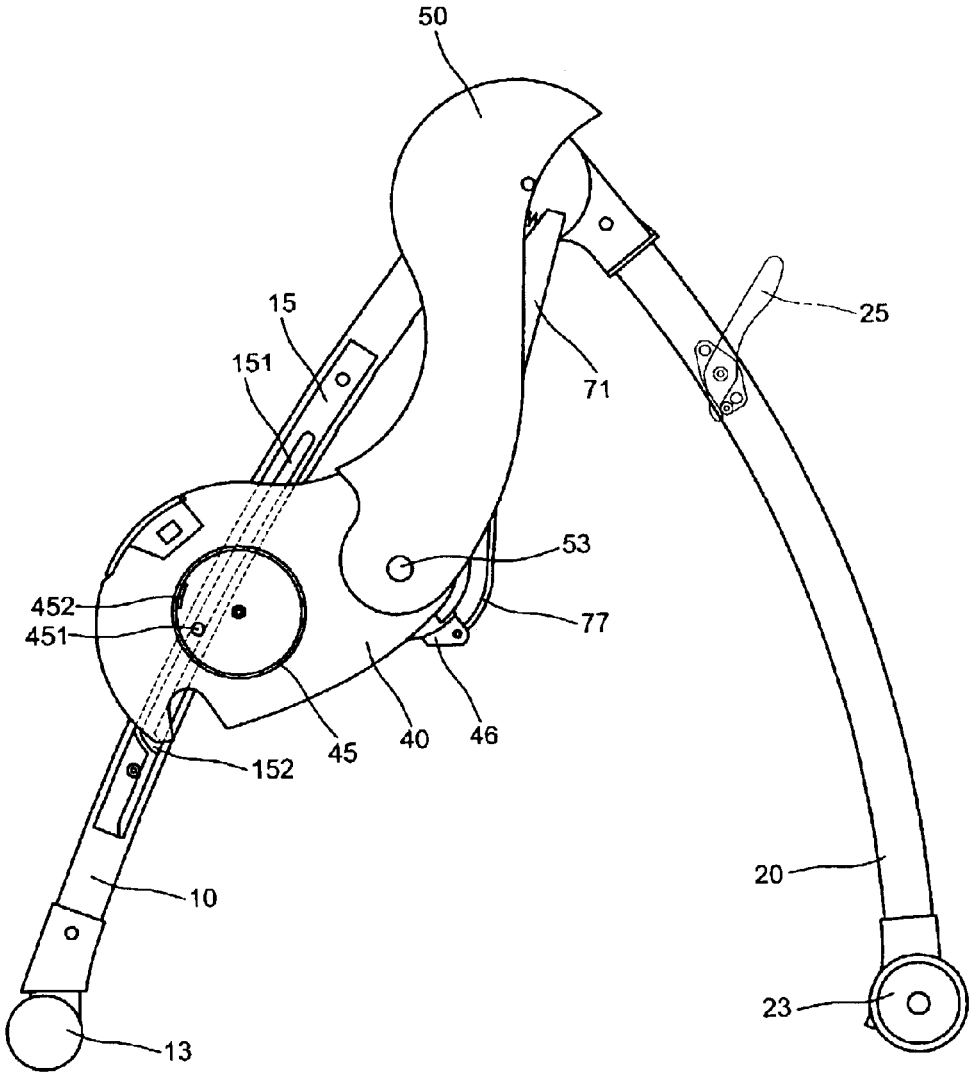
FIG. 21 is a side view to show a guide rod sliding in a guide groove in the fore legs.
Figure 22:
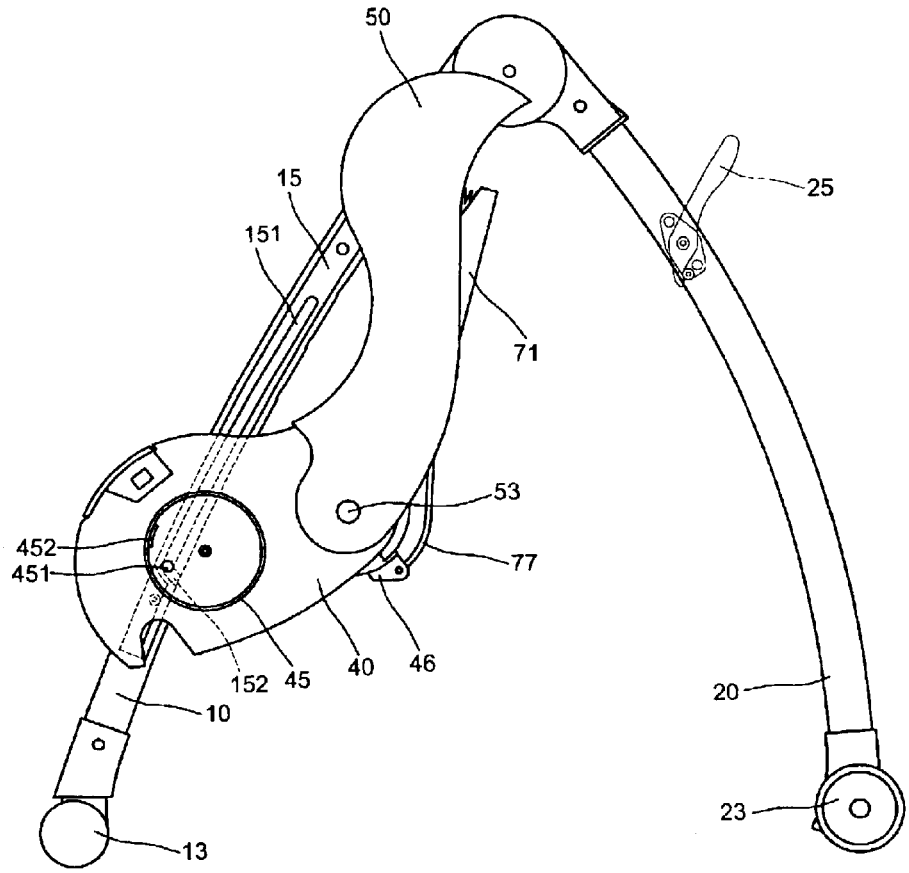
FIG. 22 is a side view to show the guide rod moved to an outlet of the guide groove.
Figure 23:
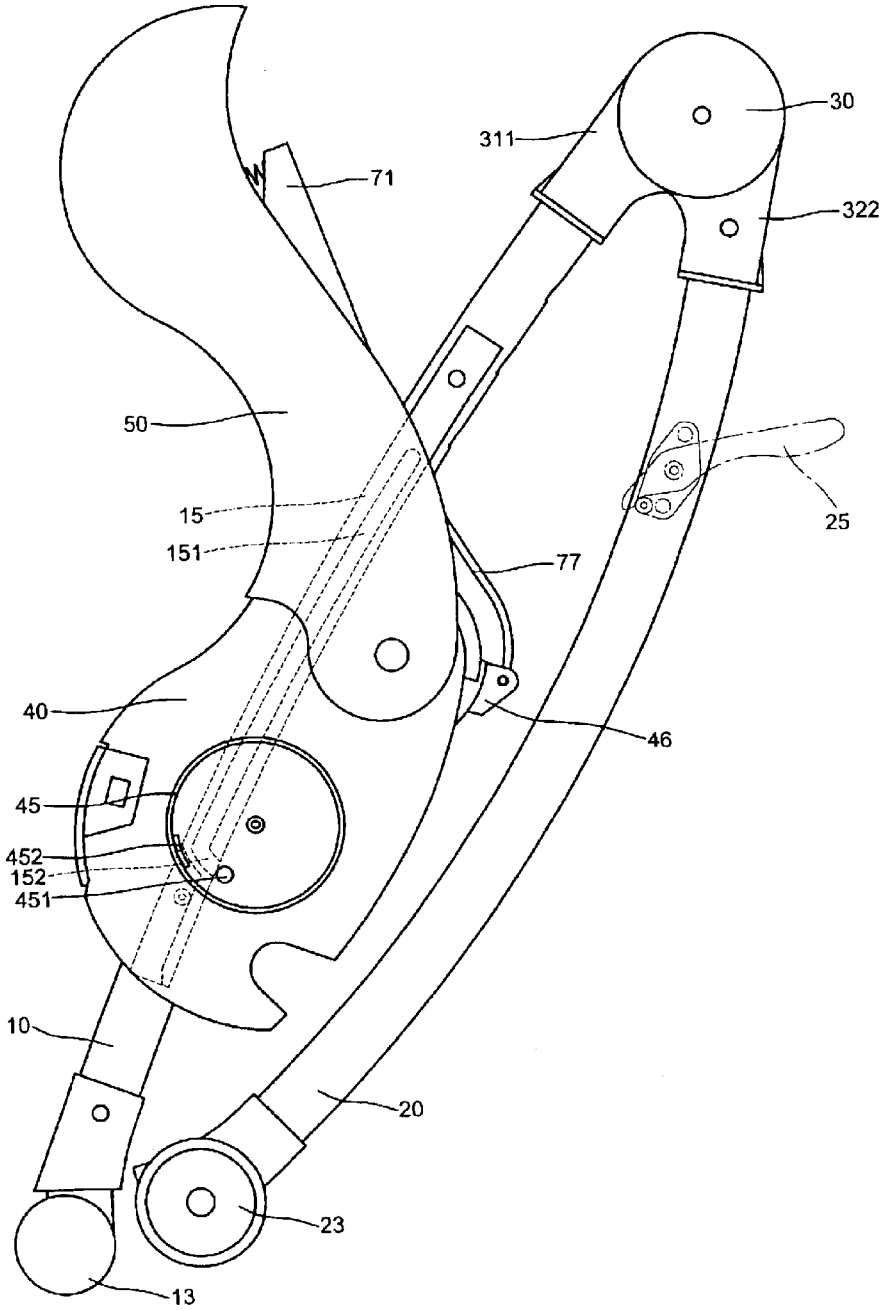
FIG. 23 is a side view to show that the guide rod is escaped from the outlet and the fore and rear legs are collapsed.

The fore legs 10 and the rear legs 20 are relatively arcuate inward. A first stretcher 11 has a first caster seat 12 perpendicularly secured to each end and respectively sleeved onto the lower end of the fore legs 10. Each of the first caster seats 12 has a caster 13 rotatably secured to lower end. The casters 13 can turn around to change direction for the chair. A second stretcher 21 has a second caster seat 22 perpendicularly secured to each end and respectively sleeved onto the lower end of the rear legs. Each of the second caster seats 22 has a pair of casters 23 coaxially secured to two lateral sides. The rear side of the upper portion of the fore legs 10 has a plurality of inclined surfaces 14 continuously formed (as shown in FIG. 15) so as to define a plurality of shoulders 141 at their lower ends. The upper inner side of each fore leg 10 parallel connects a sliding bar 15 each of which has a guide groove 151 in the center along the length thereof (as shown in FIG. 21). The guide grooves 151 each has a transverse outlet 152 above their lower ends.

Figure 4:
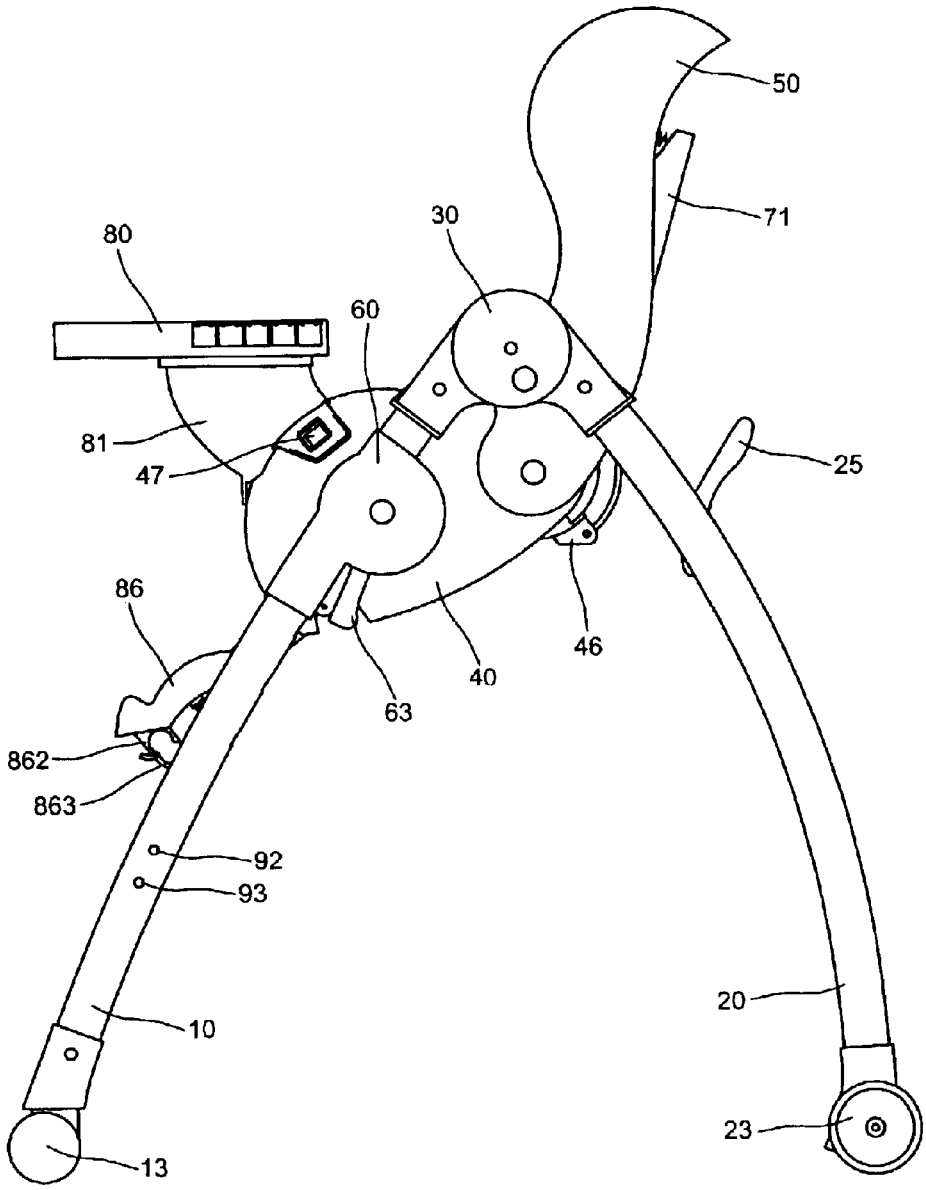
FIG. 4 is a side view of FIG. 3.
Figure 5:
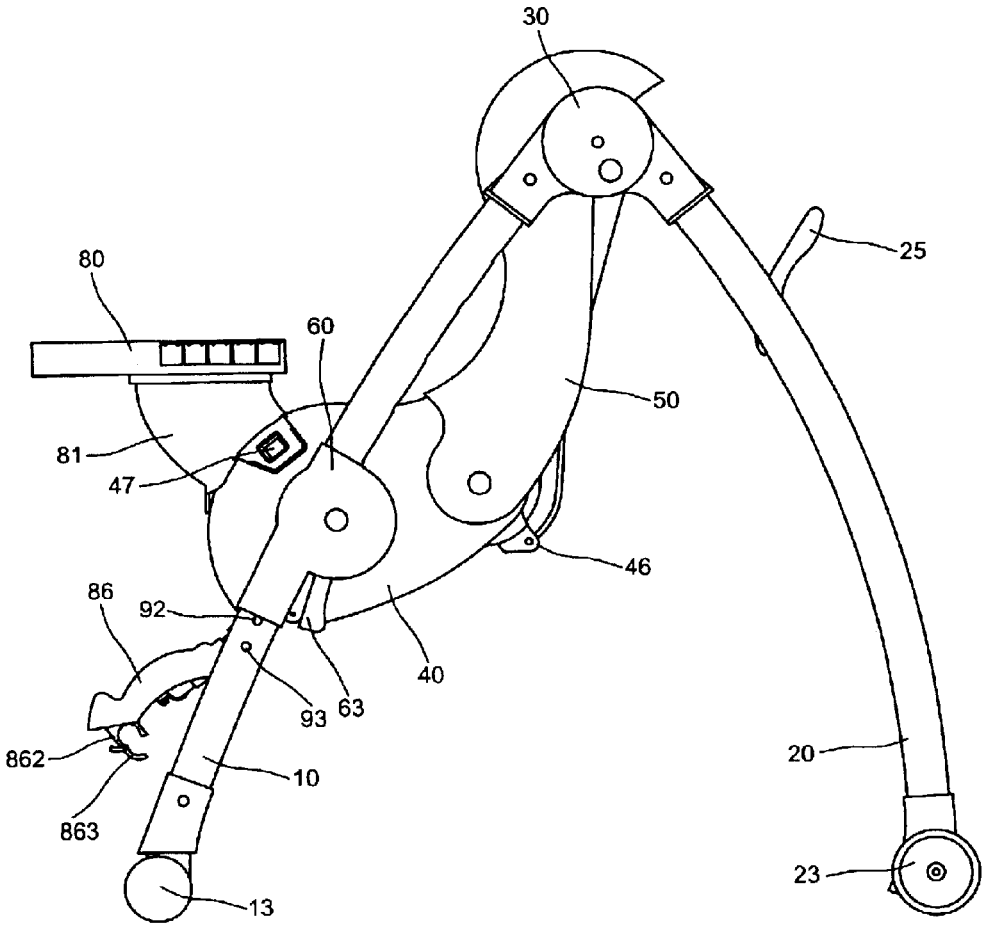
FIG. 5 is a side view indicating the descent of the chair seat.
Figure 6:
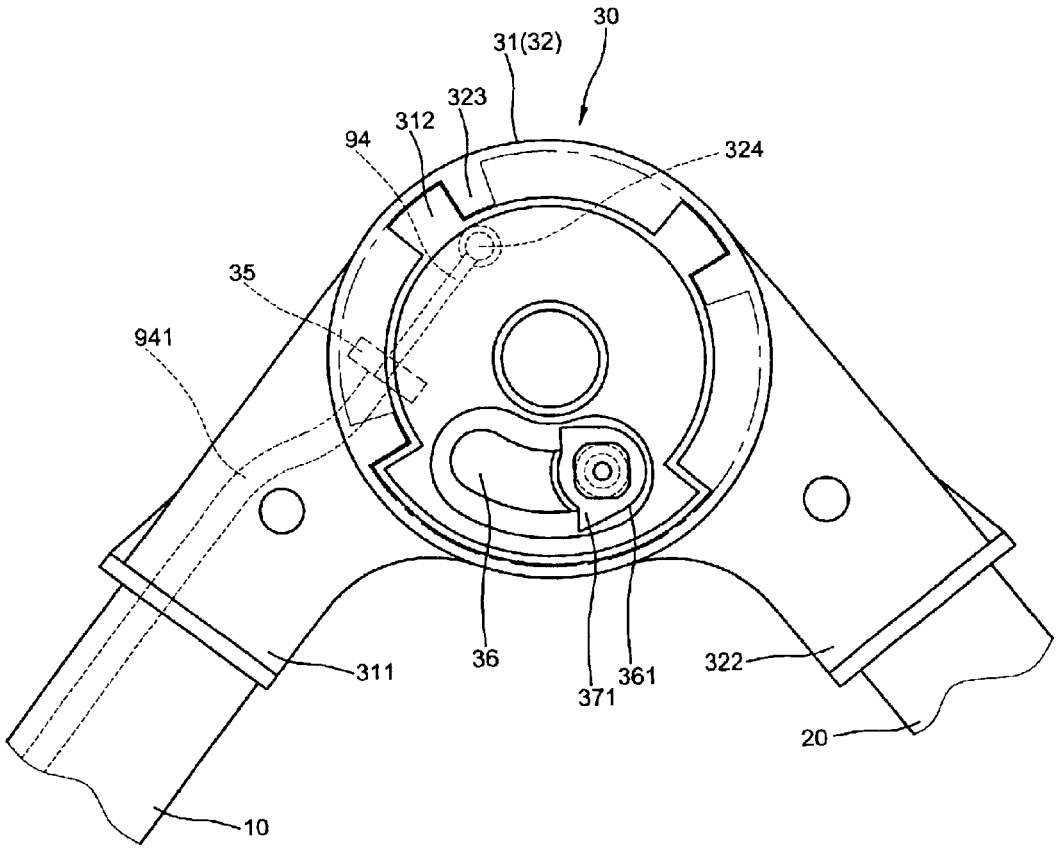
FIG. 6 is a side view to show the inner structure of the circular joint.
Figure 7:
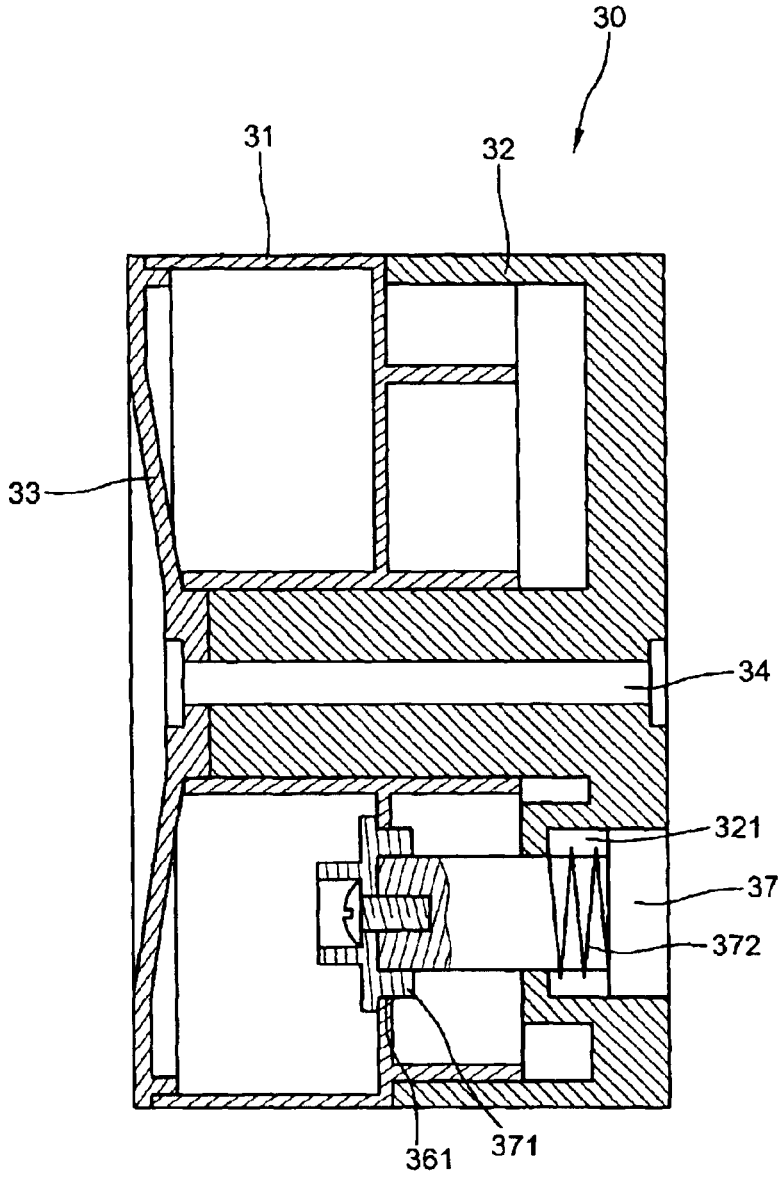
FIG. 7 is a sectional view of FIG. 6.
Figure 8:
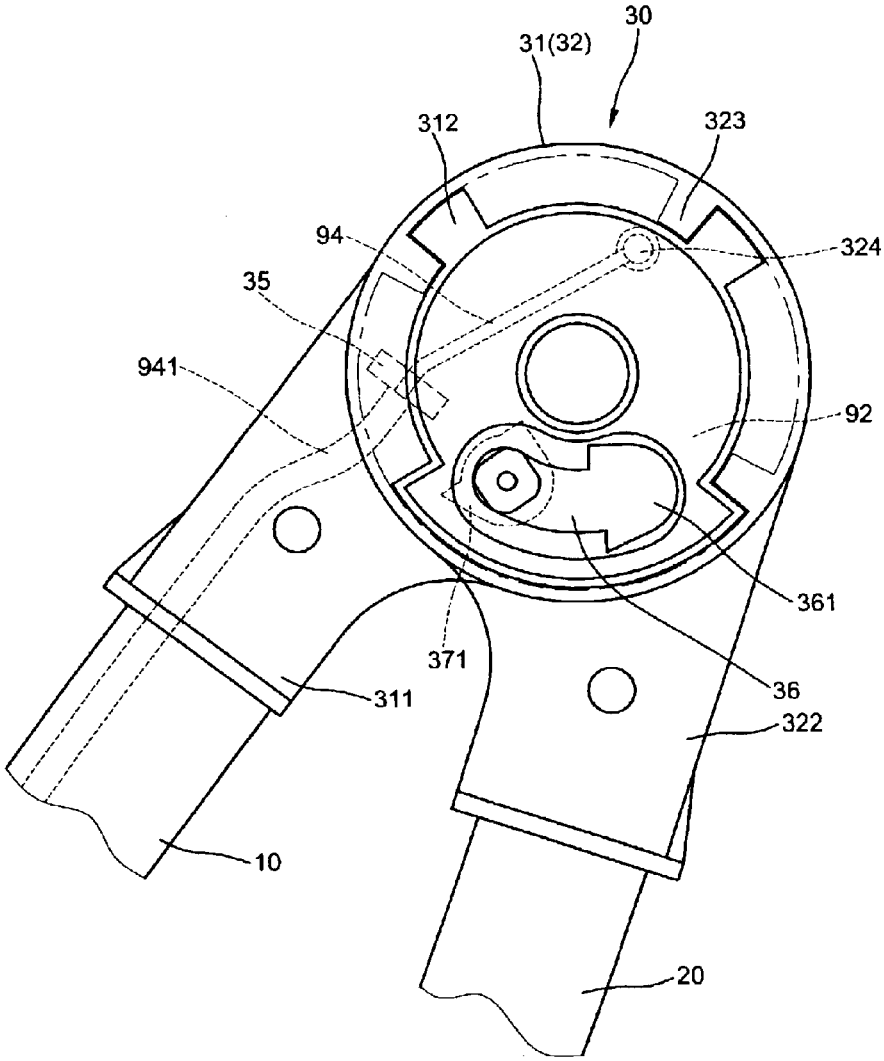
FIG. 8 is a side view to show the operation of the circular joint.
Figure 9:
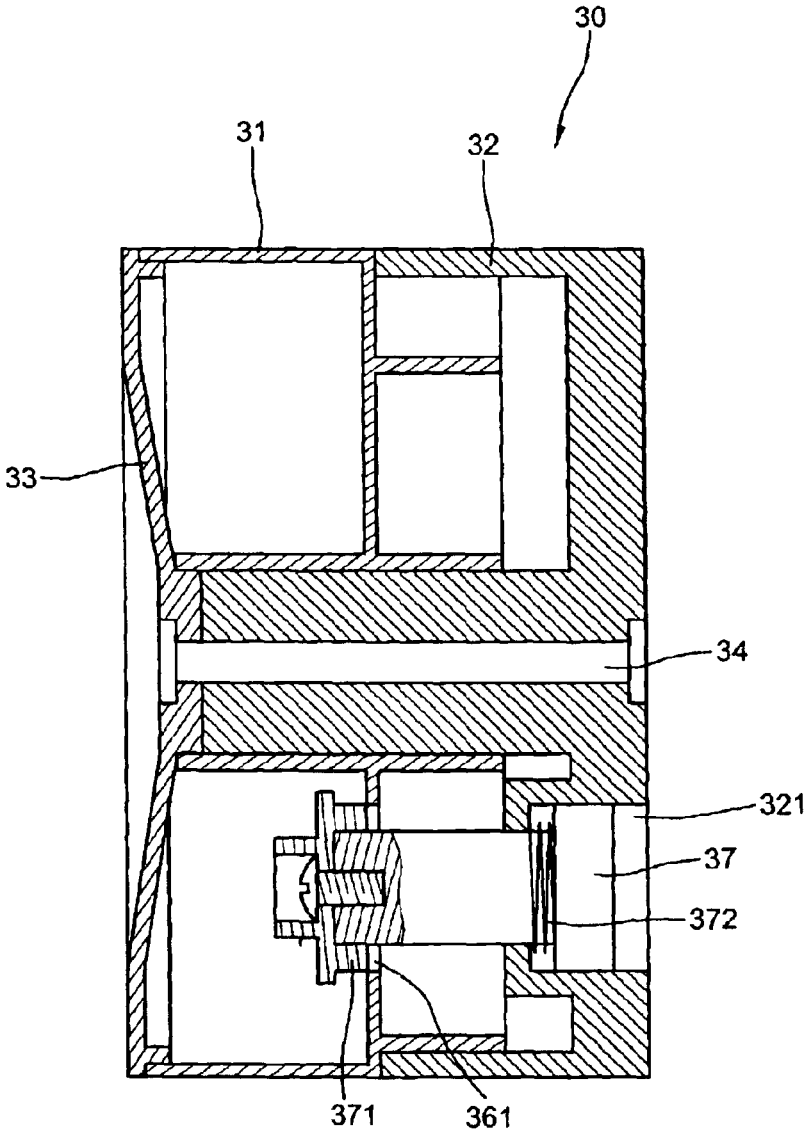
FIG. 9 is a sectional view of FIG. 8.
Figure 10:
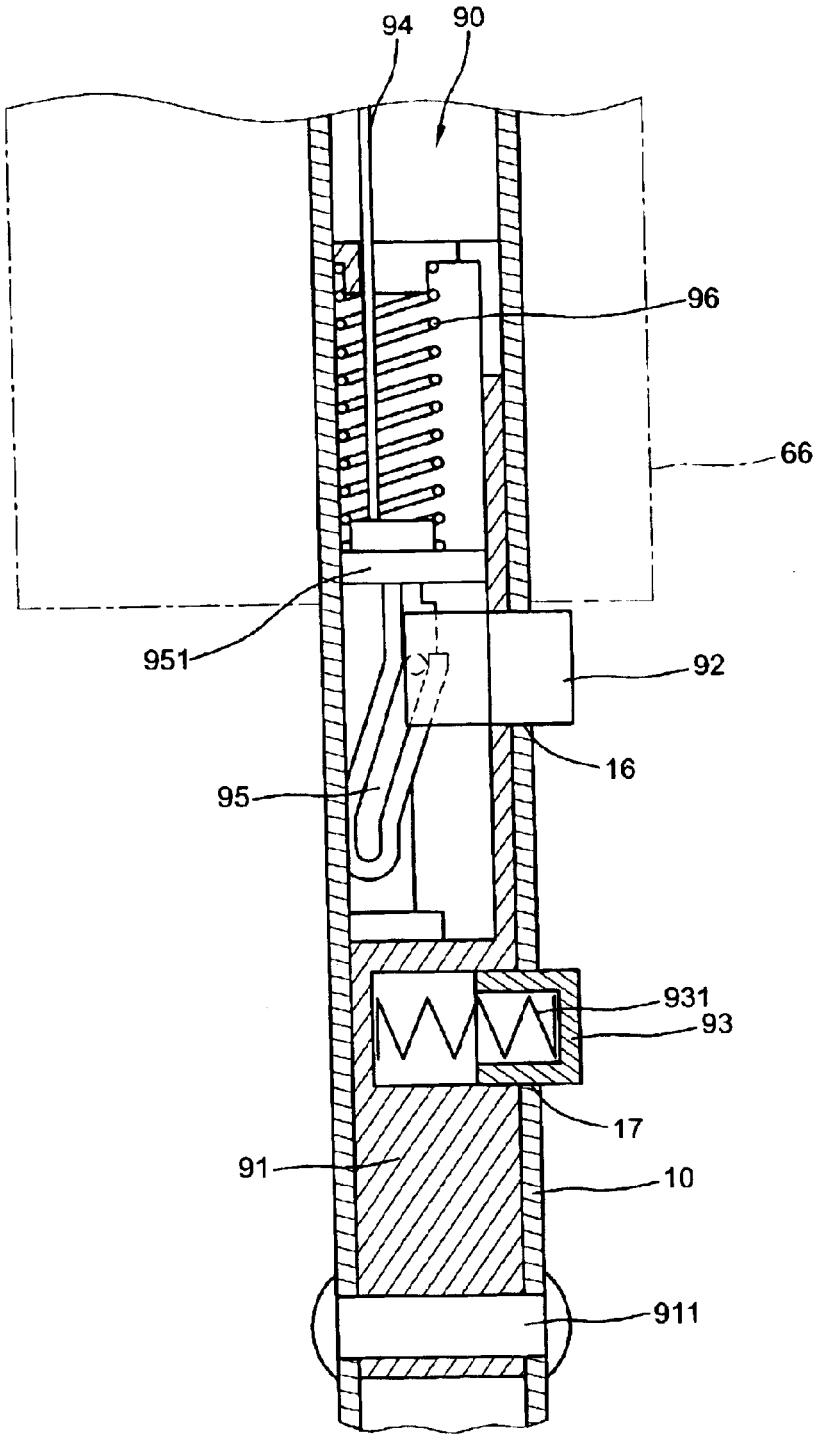
FIG. 10 is a sectional view to show a drag device inside the fore legs.
Figure 12:
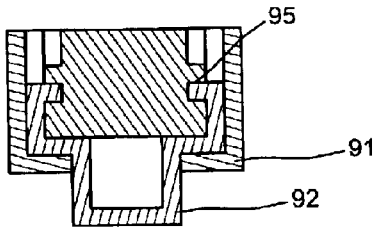
FIG. 12 is a sectional view to show an upper stopper of the drag device.
Figure 11:
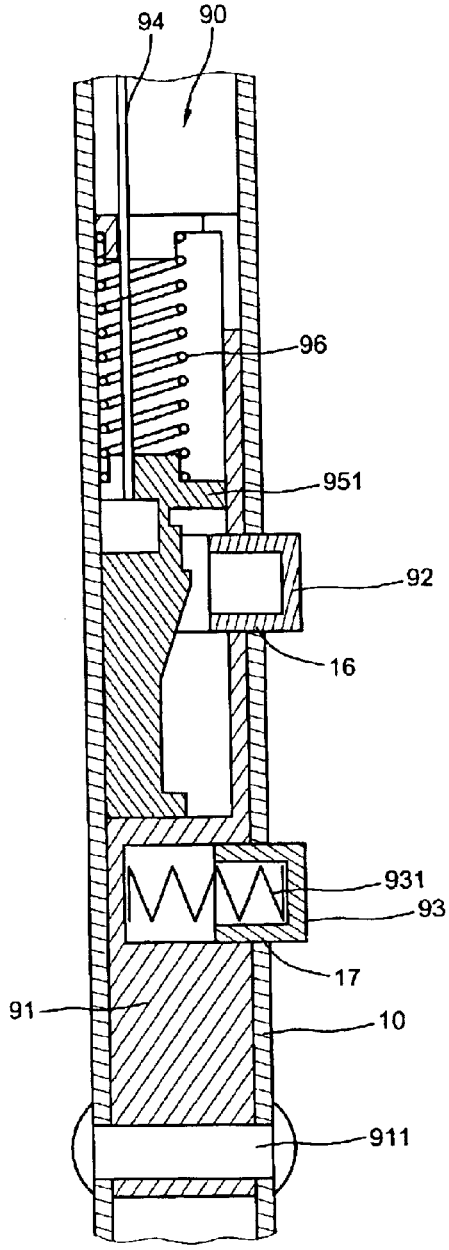
FIG. 11 is another sectional view of the drag device.

The two circular joints 30 are the some structure but symmetrically arranged. Each of the circular joints 30 is combined with an inner disk 31, an outer disk 32 and an inner cap 33 co-axially and rotatably connected by an axial pin 34 (as shown in FIGS. 6 and 7). The inner disk 31 has a plurality of first stop blocks 312 spacedly formed around inner circumference, an arcuate guide slot 36 abutting an abnormal through hole 361 in a lower portion and a first sleeve 311 extended downward from a lower periphery for connecting itself to the upper end of the fore legs 10. The outer disk 32 has a plurality of second stop blocks 323 spacedly formed around the inner circumference made engageable with the first stop blocks 312 for limiting the stretching angle between the fore and rear legs 10 and 20, a small protrusion 324 on an upper inner surface for connecting a linking-up cord 94 of the drag device 90, a stop plate 35 on an inner surface beneath the small protrusion 324, a through hole 321 in a lower portion engageable with the abnormal through hole 361 for receiving a button 37 which is biased by a spring 372 and secured at fore end by a fixed plate 371 in the abnormal through hole 361 to prevent the inner and the outer disk 31 and 32 from rotation and a second sleeve 322 extended downward from an outer periphery for connecting itself to the upper end of the rear legs 20 each of which has a coupling seat 24 secured to a middle inner side. Each of the coupling seat 24 has a stop rod 241 and an axial rod 242 for rotatably securing a spare support 25 which has a long portion 251 toward the ground when the legs 10 and 20 are collapsed and a short portion 252 engageable with the stop rod 241 (as shown in FIGS. 2, 3, 4 and 5).

Figure 17:
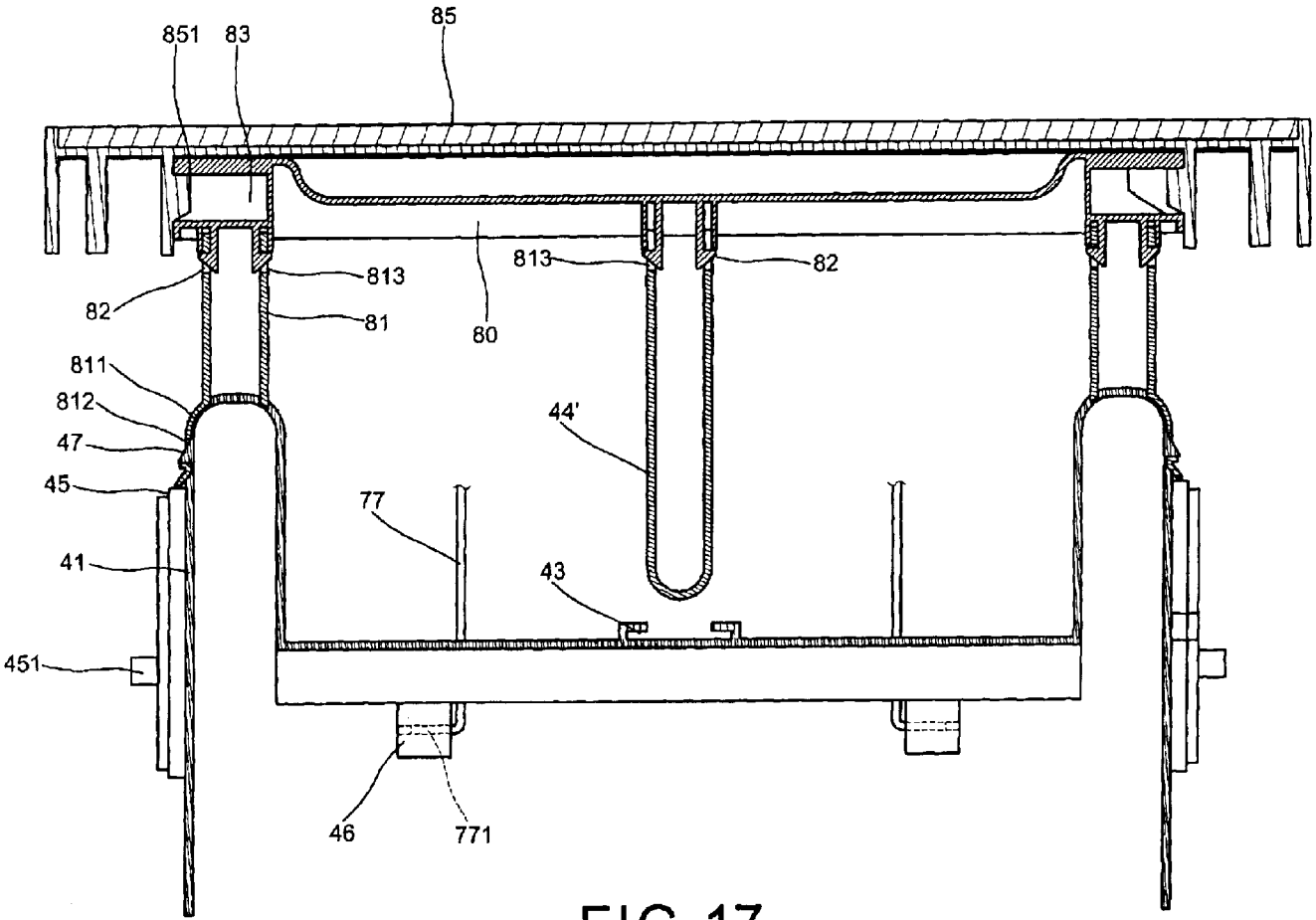
FIG. 17 is a sectional view to show the small platform simultaneously connected to the chair seat and a central upright support.
Figure 18:
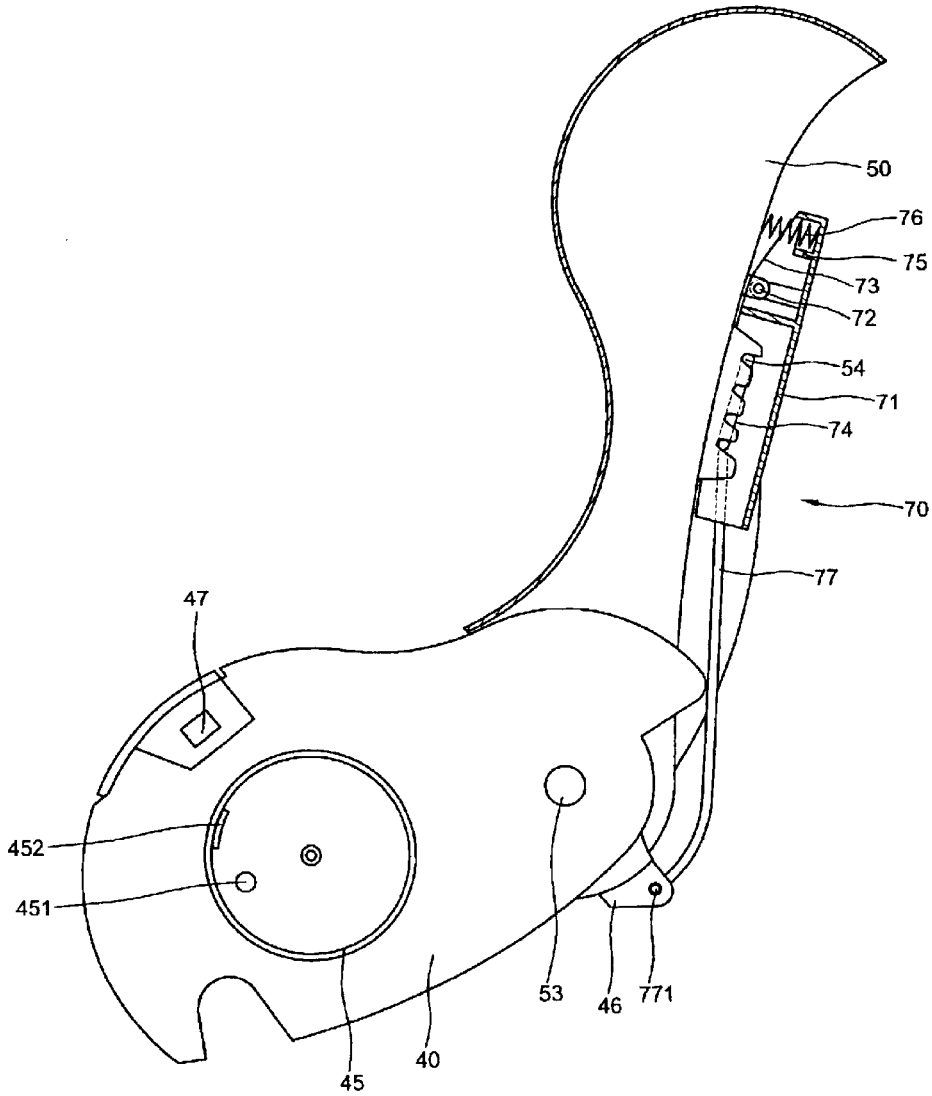
FIG. 18 is a side view to show the angle adjustment device on a chair back.
Figure 19:
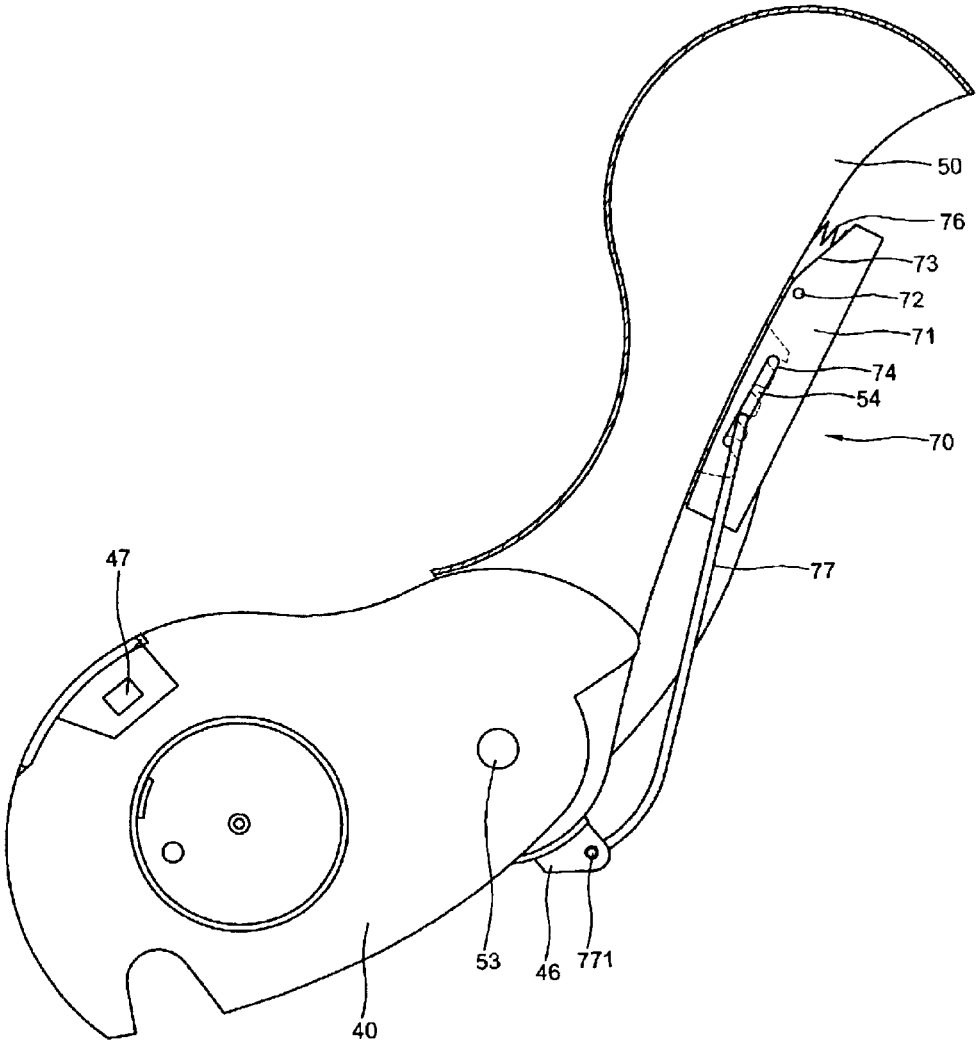
FIG. 19 is a side view to show the operation of the angle adjustment device.

The chair seat 40 (as shown in FIGS. 1 and 2) has a pair of lateral walls 41 each of which has a through hole 42 in rear portion, a ring guide 45 on fore outer portion, a guide rod 451 inside the ring guide 45, a guide plate 452 above the guide rod 451, a lug 46 on an underside of the rear portion, a protudent triangular plate 47 on a top of the fore edge (as shown in FIGS. 17 and 18), and a horizontal U-shaped inlaid slit 43 centrally formed in an upper surface of the seat 40 for securing a central upright support 44 which has a rectangular plate 441 on bottom anchored within the U-shaped inlaid slit 43.

The chair back 50 has a pair of hollow interior lateral walls each having an aligned through hole 53 above lower end engaged with the through holes 42 of the chair seat 40 and rotalably connected by two pairs of fasteners 51 each of which includes a pair of elastic hooks 52 at fore end (as shown in FIGS. 1, 2 and 18) and a plurality of positioning grooves 54 on the back side of the chair back 50.

The two rotary positioning joints 60 respectively and rotatably secured to the ring guides 45 of the chair seat 40 by a pair axial rod 61, and each has a rectangular tube 62 including a longitudinal guide projected downward through the body to slidingly sleeve onto the upper portion of the fore legs 10 and attached on the sliding bars 15, a positioning handle 63 pivoted to an outer surface of each of the rotary positioning joints 60 by an axial pin 631 and biased by a spring 633, a pair of check rods 632 connected to the upper end of the positioning handle 63. The check rods 632 have their forward end stopped against one of the shoulders 141 of the fore legs 10, an opening 64 in the lower portion of each of the rotary positioning joints 60 including a stop edge to limit the movement of the guide rod 451 of the chair seat 40. This arrangement aims to provide a relative rotation angle to the chair seat 40 and an outer cap 66 secured to the outer side of each of the rotary positioning joints 60 by screws 65. The outer caps 66 each has an extension 661 covering the outer surface of the rectangular tube 62 (as shown in FIGS. 1, 2, 3, 14 and 15).

Referring to FIGS. 2, 16, 18, 19 and 20, the angle adjustment device 70 comprises a rectangular plate 71 pivoted to a lug on the chair back 50 by an axial pin 72. The plate 71 has a pair of side walls each including a bevel upper edge 73 and a concave lower edge 74, a circular ring 75 centrally formed on an inner surface abutting the upper edge for anchoring one end of a spring 76 which has another end stopped against the chair back 50 for providing resilience to the rectangular plate 71 and an inverse U-shaped rod 77 having a pair of transverse ends 771 respectively engaged into the lugs 46 under the chair seat 40, a transverse top being selectively engaged with one of the positioning groves 54 and the lateral portions confined by the concave lower edges 74 from moving outside of the plate 71. If one pulls the lower end of the rectangular plate 71 outward, the lower portion of the plate 71 will leave the chair back 50 so as to set the inverse U-shaped rod 77 free to engage within any other positioning groove 54 to adjust the angle of elevation for the chair back 50. Once the adjustment of the angle of elevation is achieved, release the rectangular plate 71 which will move back to its original position due to the resilience of the spring 76.

Figure 16:
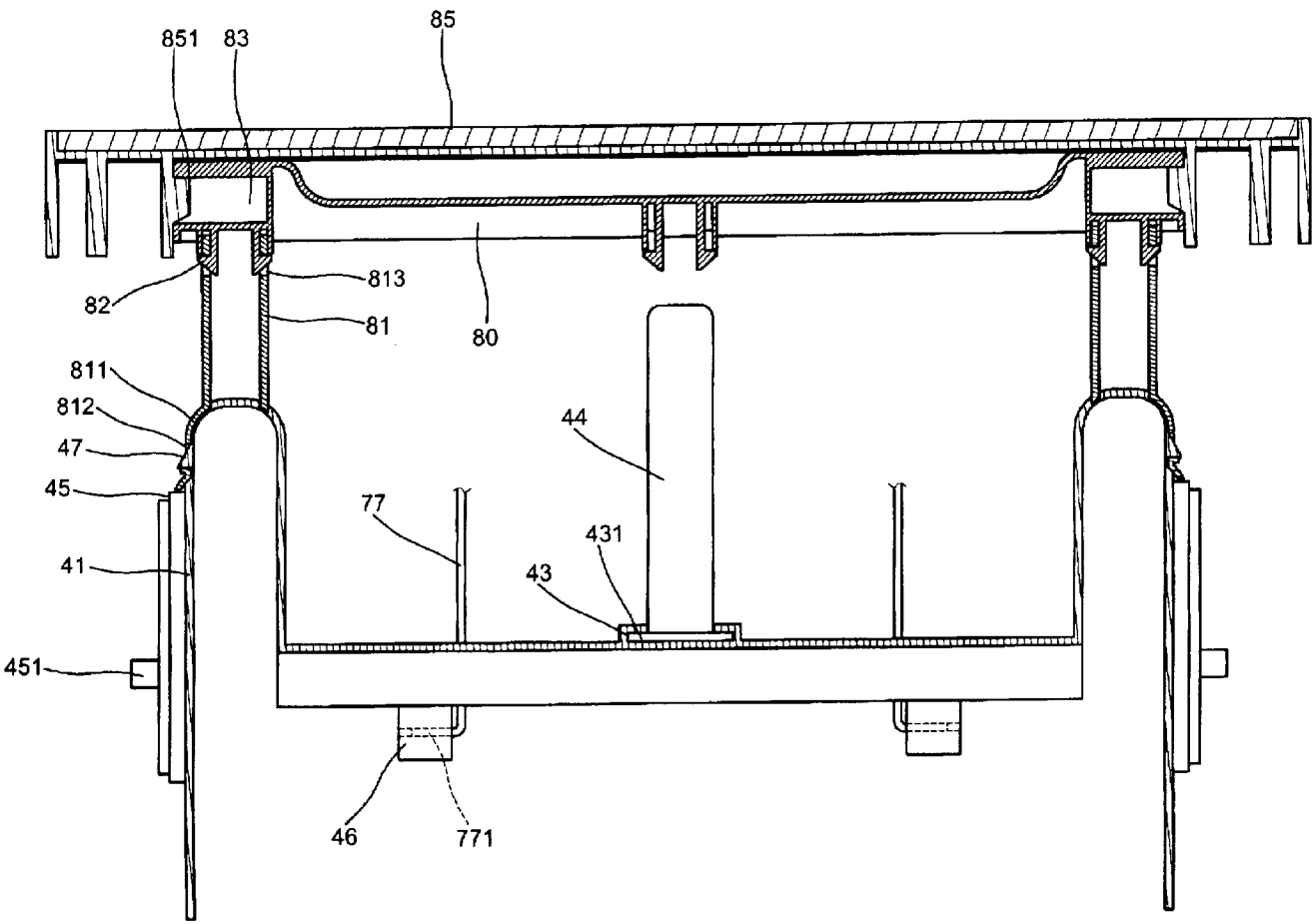
FIG. 16 is a sectional view to show a small platform connected to the chair seat.

Referring to FIGS. 2 and 16, a pair of symmetrically arranged side support plates 81 each has a clipping plate 811 including a rectangular hole in the center engaged with the protrudent triangular plates 47 of the chair seat 40 respectively and a pair of aligned rectangular through holes 813 spacedly formed under upper edge for engaging within a pair of hooked connecters 82 under the small platform 80. The lateral edges of the small platform have a plurality of retaining slots 83 which are able to hold a pair of elastic inlaid blocks 851 under a large platform 85 which can be slid to and fro on the small platform 80. Due to that the large platform 85 is made of plastic material, and the inlaid 851 blocks are elastic.

Figure 20:
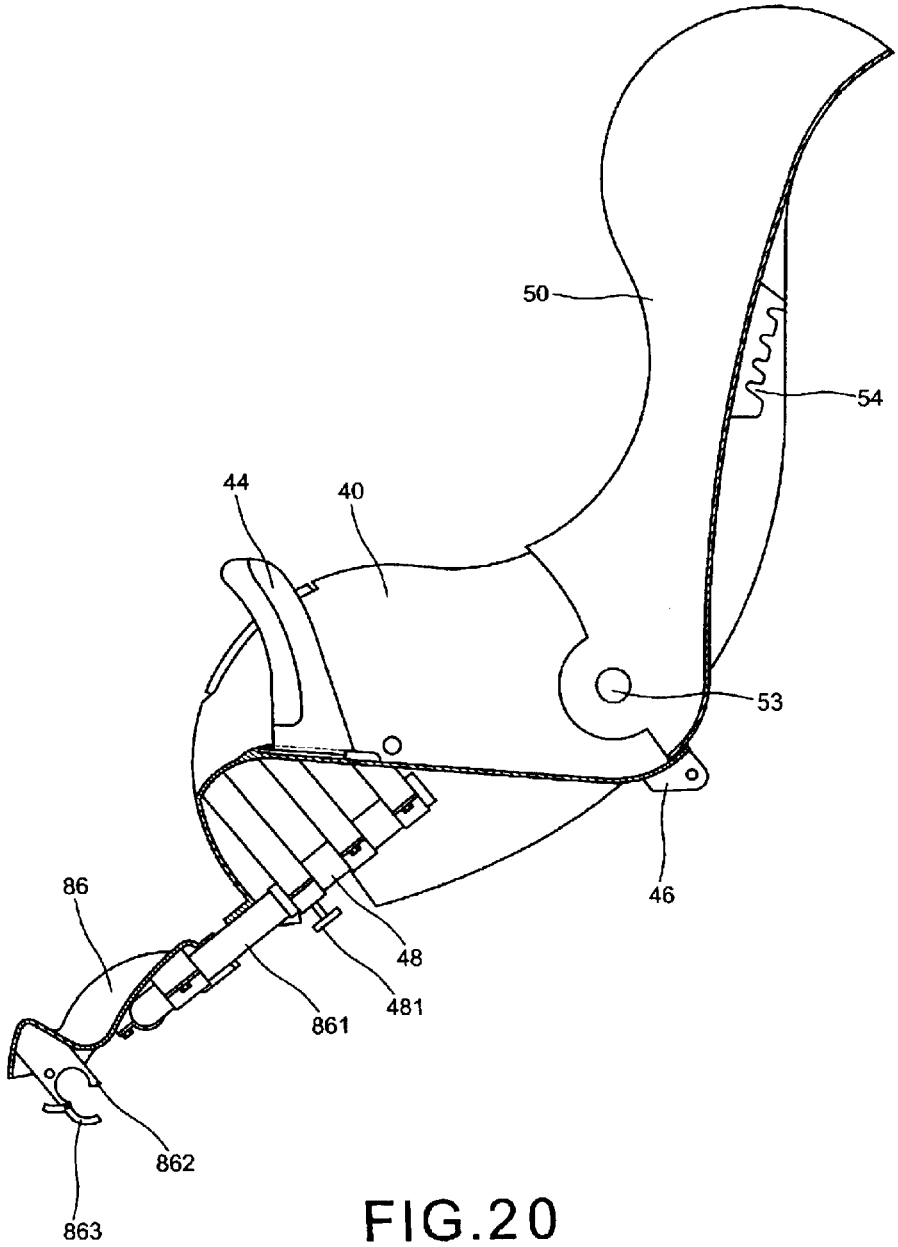
FIG. 20 is a side view to show the structure of a foot rest under the chair seat.
Figure 24:
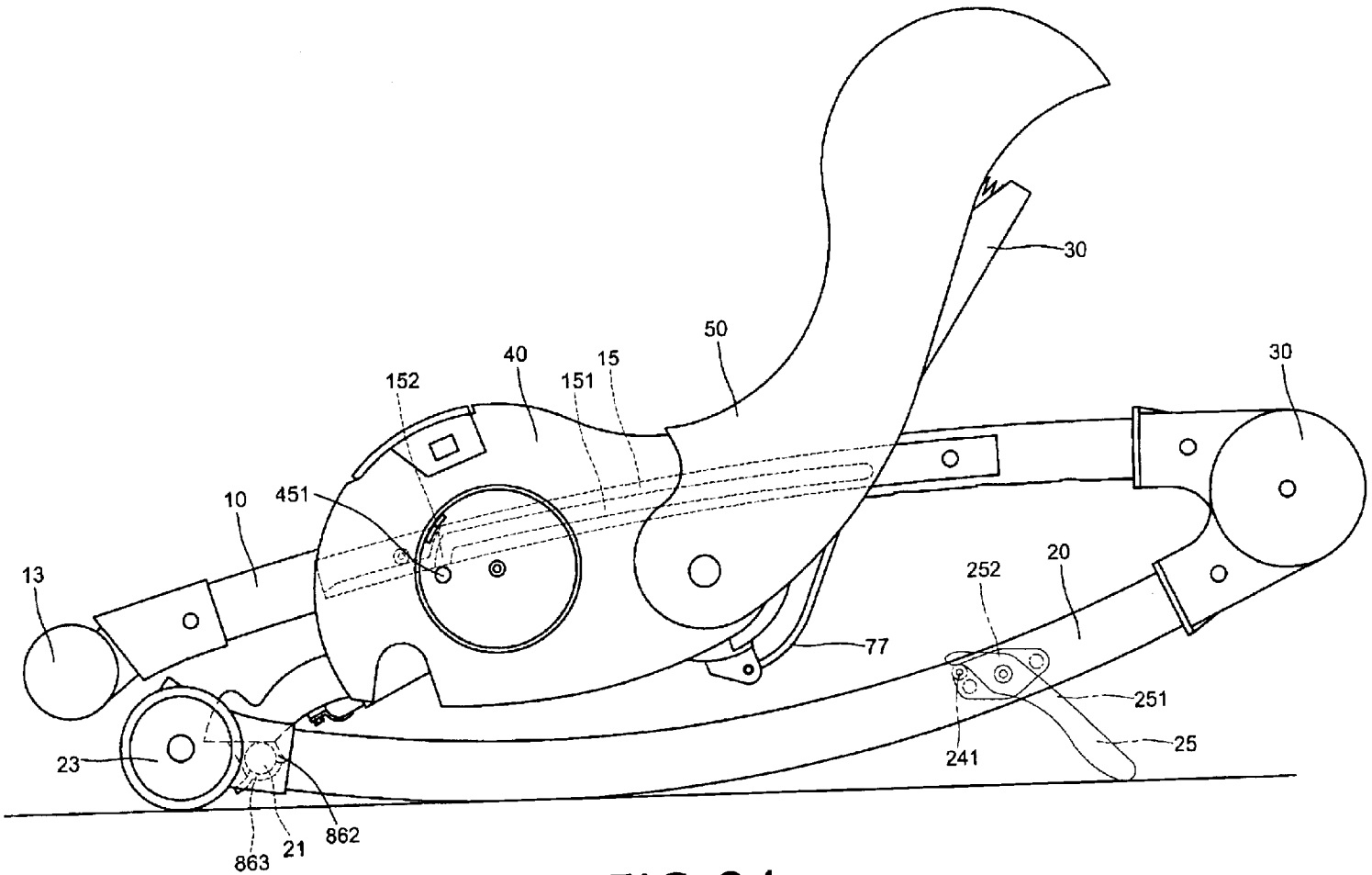
FIG. 24 is a side view to show that the high chair of the present invention is in a motionless static.

Referring to FIGS. 1, 20 and 24, a foot rest 86 is positioned under the chair seat 40 through a pair of connection tubes 861 which insert into a pair of sleeves 48 beneath the chair seat 40 and releasably secured by bolts 481. So that the foot rest 86 is vertically adjustable. An inverse U-shaped collet 862 in cooperation with a catch 863 are formed under the lower end of the foot rest 86 which are provided to releasably clip the second stretcher 21 of the rear legs 20 when the legs 20 are collapsed in order to temporarily fix the chair seat 40.

Figure 13:
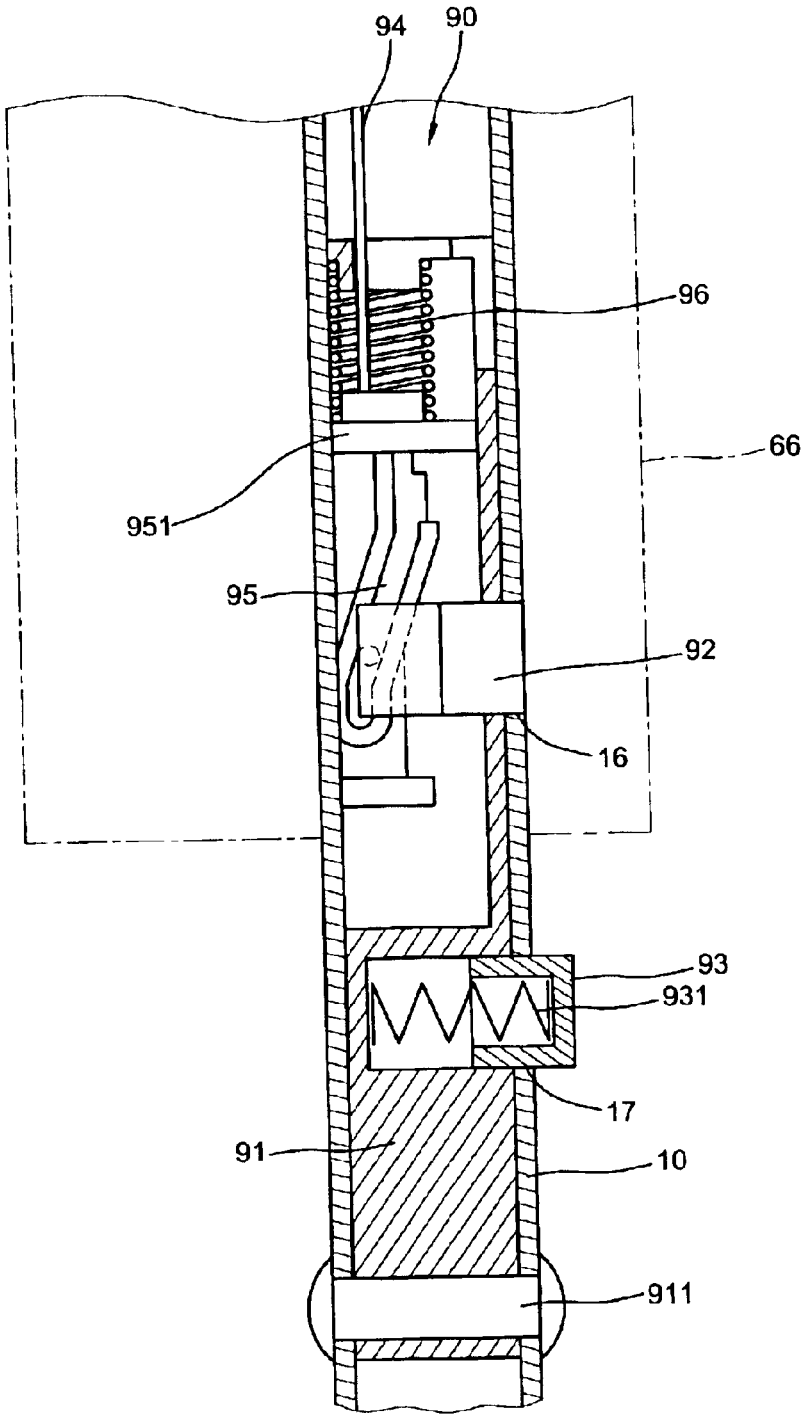
FIG. 13 is a sectional view to show that the upper stopper moves inward as a linking-up cord of the drag device is drawn upward.
Figure 14:
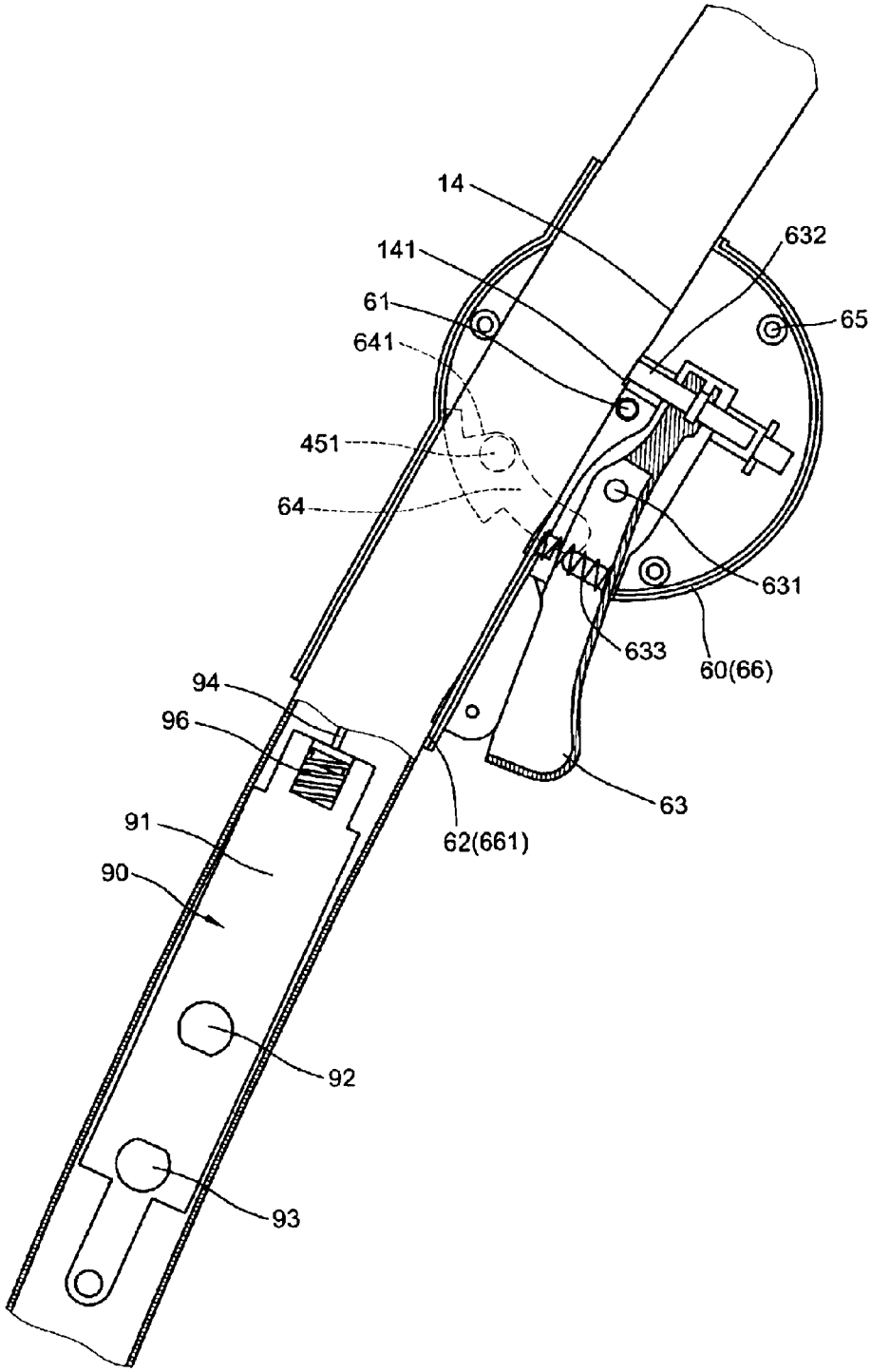
FIG. 14 is a sectional view to show a rotary positioning joint on the fore legs.

Referring to FIGS. 1, 10, 11 and 12, the pair of drag devices 90 are respectively disposed into the two fore legs 10 and each has a box 91 secured to a lower portion of the fore legs 10 by rivets 911, an upper stopper 92 inserted into a through hole 16 of the fore legs 10 and confined within a movable guide 95 which is connected to an underside of a sliding plate 951, a lower stopper 93 inserted into the box 91 via a through hole 17 of the fore legs 10 biased by a spring 931, another spring 96 biased the top of the sliding plate 951 and a linking-up cord 94 having a lower end connected to the sliding plate 951, an upper end connected to the small protrusion 324 of the outer disk 32 and a wrapper 941 stopped against the stop plate 35 (as shown in FIG. 6). The upper and lower stoppers 92 and 93 are normally protruded to outside of the fore legs 10. When the inner disk 31 and the outer disk 32 of the circular joints 30 are rotated relatively, the movable guides 95 are lifted up to force the upper stopper 92 to move inside of the fore legs 10 in order to permit the rotary positioning joints 60 together with the chair seat 40 descending to the lower stopper 93 (as shown in FIG. 13). Referring to FIGS. 3, 4 and 5, when the fore legs 10 and the rear legs 20 are stretched and automatically fixed by the pair of circular joints 30, the chair seat 40 is at an uppermost position. If tries to descend the chair seat 40 or to collapse the legs 10 and 20, press simultaneously the positioning handles 63 of the rotary positioning joints 60, the check rods 632 are actuated to leave the shoulders 141 of the fore legs 10 so as to permit the chair seat 40 descending to next shoulders 141. Then release the handle handles 63, the check rods 632 will automatically check on the next shoulders 141 to stop the chair seat 40. Because of that the longitudinal guides of the rotary positioning joints 60 have the some curve as that of the fore legs 10, the angle of elevation of the chair back 50 is kept unchanged. If ascends the chair seat 40, it is no need to press the positioning handles 63 but just moves the chair seat upward, the check rods 632 will automatically slide along the inclined surface 14 and check into the upper shoulders 141 of the fore legs 10.

Referring to FIGS. 5, 6, 7, 8, 9, 21 and 22, when the chair seat 40 descends to the upper stoppers 92, simultaneously press the buttons 37 of the circular joints 30 to force the fixed plates 371 moving inward to take apart from the abnormal holes 361 and move to other end of the arcuate guides 36. So that the inner desks 31 and the out disks 32 of the circular joints 30 can be able to rotate relatively to readily collapse the fore and rear legs 10 and 20. The rotation of the outer disks 32 draws the linking-up cords 94 which lift the movable guides 95 upward that force the upper stoppers 92 moving into the fore legs 10. Therefore, the rotary positioning joints 60 can be able to descend to the lowermost position and stop by the lower stoppers 93. Meanwhile, the guide rods 451 of the ring guides 41 can slide out of the outlets 152 of the guide grooves 151. But the guide plates 452 still remain outside of the guide grooves 151 to prevent the chair seat 40 from taking apart.

Figure 25:
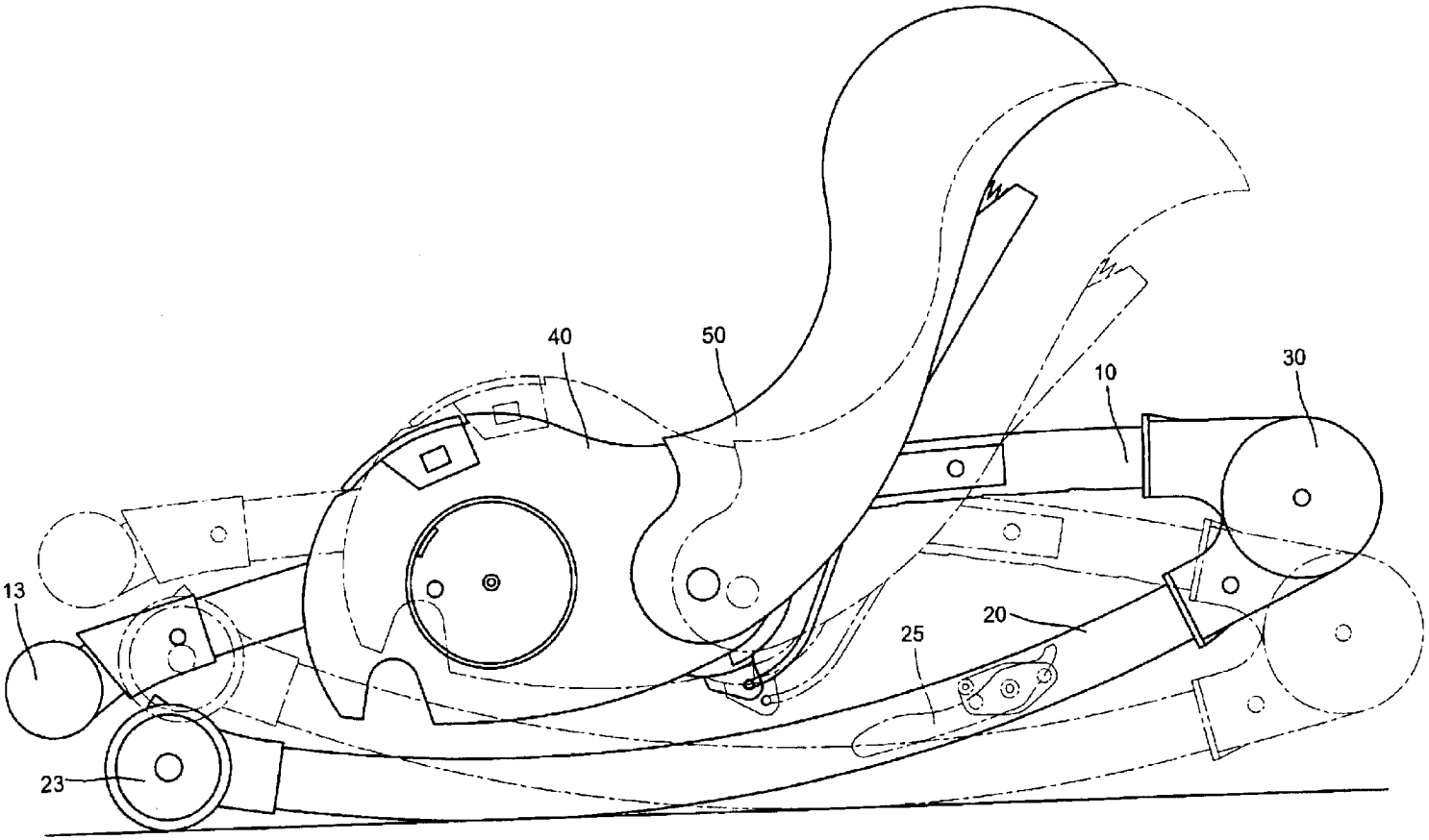
FIG. 25 is a side view to show that the high chair of the present invention is wobbling.

Referring to FIGS. 24 and 25, when the legs 10 and 20 are collapsed, put the rear legs 20 on the ground and the collet 862 and the catch 863 of the foot rest 86 clip the second stretcher 21 of the rear legs 20. The chair seat 40 together with the chair back 50 are at center position. This time, the high chair of the present invention becomes a cradle for the child and can be able to swing to and fro to cheer up the child. If stops the swinging, and pulls the spare support 25 rearward, its short portion 252 will be checked by the stop rod 241 and its long portion 251 will stop against the ground. So that the chair becomes a stable bed for the child.

If props the chair again, stretches the fore and rear legs 10 and 20, the buttons 37 will move from the arcuate guides 36 to the abnormal holes 361 and the fixed plates 371 will automatically anchor in the abnormal holes 361 due to resilience of the springs 372. Then puts the guide rods 451 of the chair seat 40 into the guide grooves 151 via the outlets 152 to facilitate the vertical adjustment of the chair seat 40 until that the check rods 632 stop against the appropriate shoulders 141 of the fore legs 10.

Referring to FIG. 17, which shows an alternate central upright support 44' to replace the original central upright support 44 and which is not anchored in the horizontal U-shaped inlaid slit 43. But has an aligned rectangular through hole 82 adjacent upper end to retain the hooked connector 82 from a center of the underside of the small platform 80. This small modification has also the function of protecting the child.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A multi-functional child high chair comprising:

a pair of fore legs and a pair of rear legs relatively arcuate inward, said fore legs each having an upper and a lower through end a pair of holes spacedly formed in a lateral side above lower end, a plurality of inclined surfaces continuously formed on an inner side under said upper ends to define a plurality of shoulders at their lower ends, a slidingbar parallel connected to upper lateral side opposite to said through holes each having a guide groove centrally extended along the length thereof including a transverse outlet above their lower ends, a first stretcher including a pair of first caster seats perpendicular to two ends respectively sleeved onto the lower ends of said fore legs and each of the first caster seats having a turnable caster rotatably secured to lower end, said rear legs each having a coupling seat on a lateral side in mirror arrangement including a stop rod and an axial rod for rotatably securing a spare support which has a long portion engageable with the ground and an arcuate short portion engageable with the stop rod of said coupling seats, a second stretcher having a pair of second caster seats perpendicular to two ends thereof respectively sleeved onto the lower end of said rear legs and each including a pair of casters rotatably secured to lateral sides;

a pair of circular joints of identical structure in mirror arrangement and each having an inner disk, an outer disk and an inner cap co-axially and rotatably connected by an axial pin, said inner disks each having a plurality of first stop blocks spacedly formed around inner circumference, an arcuate guide slot abutting an abnormal through hole in a lower portion and a first sleeve extended downward from a lower periphery connecting the upper end of said fore legs, said outer disks each having a plurality of second stop blocks spacedly formed around inner circumference made engageable with the first stop blocks of said inner disk, a small protrusion on an upper inner surface, a stop plate on an inner surface beneath the small protrusion, a through hole in a lower portion engaged with the abnormal through hole of said inner disks for receiving a button which is biased by a spring and secured at fore end by a fixed plate in the abnormal through hole and a second sleeve extended downward from an outer periphery to connect the upper end of said rear legs respectively;

a chair seat having a pair of lateral walls each having a though hole in rear portion, a ring guide in fore outer portion, a guide rod in the ring guide, a guide plate above the guide rod, a lug on underside of rear portion and a protrudent triangular plate on a top of fore portion, and a horizontal U-shaped inlaid slit centrally formed in an upper surface of the chair seat for securing a central upright support which has a rectangular plate on bottom anchored within the U-shaped inlaid slit;

a chair back having a pair of hollow interior lateral walls each having an aligned through hole above lower end engaged with the through holes of said chair seat and rotably connected by two pairs of fasteners each of which including a pair of elastic hooks and a plurality of transverse positioning groove on back side thereof;

an angle adjustment device comprises a rectangular plate pivoted to a lug on said chair back by an axial pin, said plate having a pair of side walls each including a bevel upper edge and a concave lower edge, a circular ring centrally formed on an inner side abutting upper edge for anchoring one end of a spring which has another end stopped against the chair back, and an inverse U-shaped rod having a pair of transverse ends respectively engaged within the lugs under said chair seat, a transverse top selectively engaged one of the transverse positioning grooves for adjustment of the angle of elevation for said chair back and a pair of lateral portions being confined by the concave lower edges thereof;

a pair of symmetrically arranged side support plates each having clipping plate including a rectangular hole in center engaged with the protrudent triangular plates of said chair seat respectively and a pair of aligned rectangular through holes spacedly formed under upper edge for engaging within a pair of hooked connecters under a small platform which having a plurality of retaining slots in lateral edges for holding a pair of elastic inlaid blocks under a large platform which can be slid to and fro on the small platform;

a foot rest positioned under said chair seat through a pair of connection tubes which adjustably insert into a pair of sleeves beneath said chair seat and releasably secured by bolts and an inverse U-shaped collet in cooperation with a catch under lower end of said foot rest which is provided to clip the second stretcher when said rear legs are collapsed;

a pair of rotary positioning joints respectively and rotatably engaged with said ring guide of said chair seat by a pair of axial rods, each having a rectangular tube through the body and extended downward to slidingly sleeve onto upper portion of said fore legs and attached to the sliding bars, a positioning handle pivoted to an outer surface by an axial pin and biased by a spring, a positioning rod connected to upper end of the positioning handle having a forward end stopped against one of the shoulders of said fore legs, an opening in lower portion abutting a stop edge for limiting the movement of the guide rod of the chair seat and an outer cap secured to outer surface thereof by screws, each of said outer caps having an extension covering outer surface of the rectangular tubes;

a pair drag devices respectively disposed into said fore legs each having a box secured to lower portion of said fore legs by rivets, a movable guide connected to an underside of a sliding plate biased by a vertical spring on top, a linking-up cord having a lower end connected to a top of the sliding plate and an upper end connected to the small protrusion of said outer disk through the stop plate and a wrapper on upper portion of the cord blocked by the stop plate, an upper stopper inserted into the box via the upper through hole of the fore legs confined by the movable guide and a lower stopper inserted into the box via the lower through hole of said fore legs biased by a transverse spring, said upper and lower stopper being normally protruded to outside of said fore legs;

when said movable guides are lifted upward by the rotation of the outer disks, the upper stoppers are forced to move inward in order to permit said rotary positioning joints together with said chair seat descending to the lower stoppers.

2. The child high chair as recited in claim 1 wherein said large platform is made of plastic material.

3. The child high chair as recited in claim 1 wherein said rear legs are collapsed to take said high chair as a cradle to swing to and fro for a child.

4. The child high chair as recited in claim 1 wherein said chair back can be adjustable for its angle of elevation.

5. The child high chair as recited in claim 3 wherein said chair can be taken as a bed for a child when is support by the spare support.

6. The child high chair as recited in claim 1 further has an alternate central upright support to replace said original central upright support and has an aligned through hole adjacent upper end to retain a hooked connector from a central underside of said small platform.

* * * * *